United States Patent [19]

Mitchell

[11] Patent Number: 4,664,006

[45] Date of Patent: May 12, 1987

[54] ROTARY CUTTER APPARATUS

[75] Inventor: Wayne R. Mitchell, Muncy, Pa.

[73] Assignee: SWM Corporation, Muncy, Pa.

[21] Appl. No.: 781,251

[22] Filed: Sep. 27, 1985

[51] Int. Cl.[4] ..... B02C 18/18; B26D 1/12

[52] U.S. Cl. ..... 83/341; 83/349; 83/356.3; 83/673; 241/242

[58] Field of Search ..... 83/341, 349, 355, 356.3, 83/673, 674; 241/242

[56] References Cited

U.S. PATENT DOCUMENTS

| | | | |
|---|---|---|---|
| 1,515,377 | 11/1924 | White | 83/349 X |
| 2,399,529 | 4/1946 | Willits | 164/68 |
| 3,359,843 | 12/1967 | Mead | 83/349 |
| 3,401,585 | 9/1968 | Schmermund | 83/349 X |
| 4,119,003 | 10/1978 | Corse | 83/341 |

*Primary Examiner*—James M. Meister

[57] ABSTRACT

A rotary cutting apparatus in which the cutting of thin material is possible without the use of a curved blade. The fly and bed knives are positioned according to the formula $$C=R-\sqrt{R^2-(\text{tangent } S\times L)^2}$$

where C is bed knife camber, R is cutting radius, S is shear angle and L is rotor length. As a result of this geometry, uniform fly knife to bed knife clearance is maintained across the face of the rotor.

4 Claims, 10 Drawing Figures

ROTARY CUTTER APPARATUS

FIELD OF THE INVENTION

The present invention relates to material size reduction machinery and in particular to rotary knife cutters.

BRIEF DESCRIPTION OF THE PRIOR ART

It is known in the art to mount longitudinal knives on a central rotating assembly and to reduce material between those fly knives and adjacent stationary knives known as bed knives. An apparatus embodying this concept is shown, for example, in U.S. Pat. No. 2,399,529. As is also known in that patent, it is also known to position the fly and bed knives in separate intersecting horizontal planes so that a scissor like action is achieved by their cooperative cutting action. In such an arrangement it has, however, conventionally been necessary to fabricate one of the interacting blades with a slight curve when they are positioned at close distances. Closely spaced blades are used to cut thin materials such as plastic film. Such a curved blade is shown in FIG. 3 of said U.S. Pat. No. 2,399,529.

SUMMARY OF THE INVENTION

It is the object of the present invention to provide a rotary knife cutter without curved blades which is suitable for cutting thin material such as plastic film without ripping or tearing. In the apparatus of this invention the fly blade extends at an equal distance from the longitudinal axis of the rotor. The fly and bed knives intersect with the plane of the horizontal center lines of the rotor at equal but opposite angles. The fly and bed knives are arranged according to the formula $$C=R-\sqrt{R^2-(\text{tangent } S\times L)^2}$$

In this formula C is camber, R is the cutting radius and L is the length of the rotor and S is the angle between the bed knife and the plane defined by the horizontal centerline of the rotor. Camber is the difference in the perpendicular lateral distance between the vertical center plane of the rotor at the two ends of the bed knife. As a result of this geometry, a uniform clearance between the fly knife and the bed knife is maintained across the face of the rotor.

BRIEF DESCRIPTION OF THE DRAWINGS

The apparatus of the present invention is further described with reference to the accompanying drawings in which.

DETAILED DESCRIPTION

Figure 2:
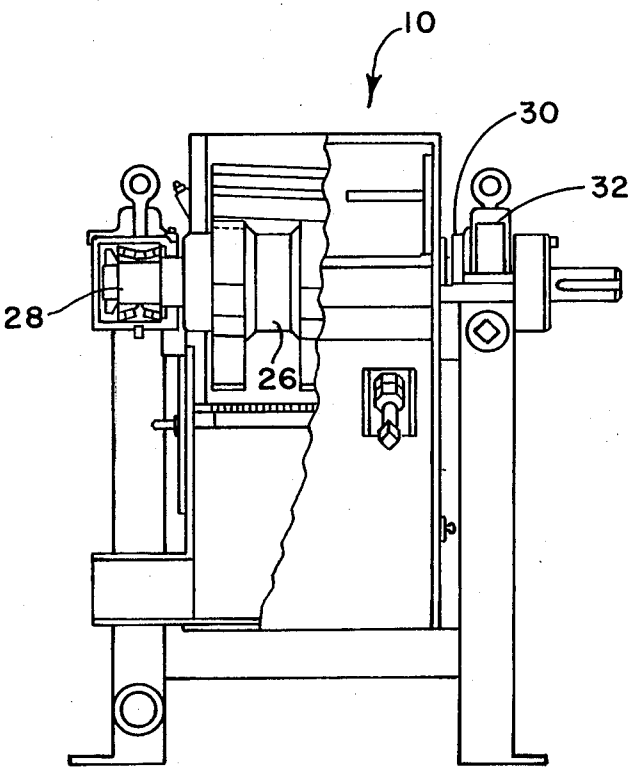
FIG. 2 is a cut away side view of the apparatus shown in FIG. 2.

With reference to the drawings, a rotary cutter is shown generally at numeral 10. This cutter includes a feed mechanism through which material to be reduced is fed before being introduced into a cutting chamber shown generally at numeral 14. Below the cutting chamber there is a concave screen 16 which has holes which will alow material which has been reduced to a sufficiently small size to pass through to a generally concave, inclined collector 18 positioned below the screen for receiving and collecting reduced material. Such material slides downwardly on the inclined collector and is removed through transition chute 20.

Mounted on the side walls of the cutting chamber there are, respectively, bed knives 22 and 24. Positioned between these bed knives is a rotor shown generally at number 26. At one end this rotor is mounted at rotor bearing 28. At its opposite end it passes through bushing 30 and has a flywheel 32 fixed to its end.

It also will be seen that the rotor has a plurality of longitudinal pockets or cut-out portions as at 34 which are arranged at spaced intervals on its periphery. Each of the pockets forms a seat as at 36 on the rotor surface. Fixed to each of said seats is a fly knife as at 38 which engages in a cooperative cutting relationship with the bed knives as the rotor is rotated about its longitudinal axis by an electric motor (not shown).

It should be understood that the above described features are well known and conventional and do not in themselves describe the invention herein. Other equivalent arrangements to accomplish the above described functions are also possible.

Figure 1:
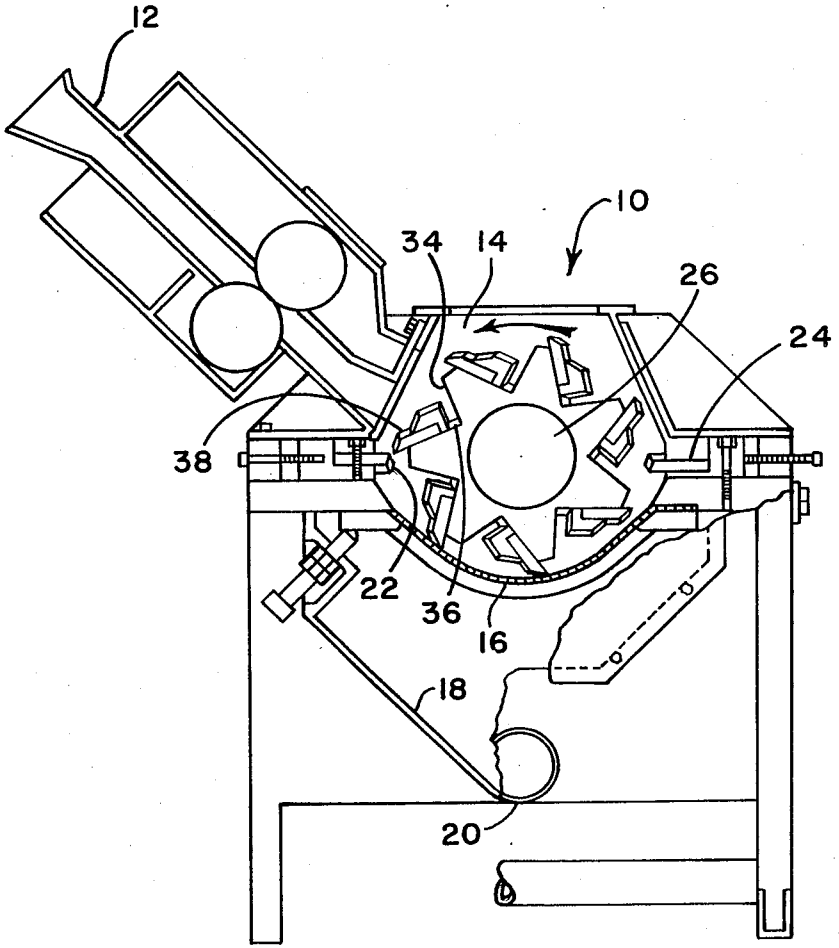
FIG. 1 is a cut away end view of a preferred embodiment of the rotary cutter apparatus of the present invention.
Figure 3:
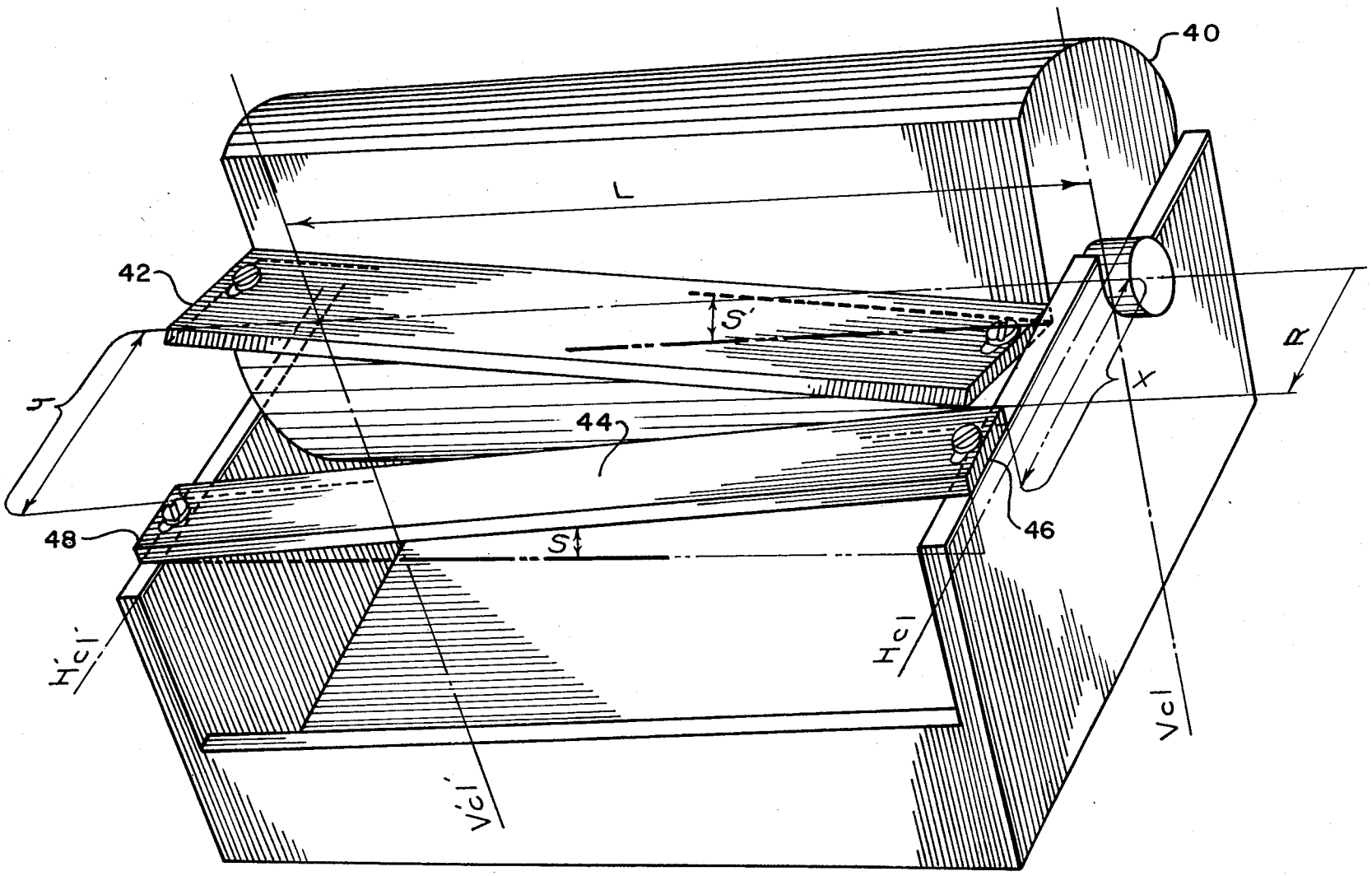
FIG. 3 is a perspective view of a rotor and bed knife arrangement which might be suitably incorporated in the rotary cutting apparatus of the present invention.

The present invention lies in the relative arrangement of the fly and bed knives. This arrangement is shown in detail in FIG. 3 which for the sake of simplicity shows an arrangement in which there is only one bed knife and one fly knife on the rotor. It will be understood, however, that this arrangement will also be applicable to rotary cutters like the one shown in FIGS. 1 and 2 in which multiple fly and bed knives are used. Referring to FIG. 3, the rotor is shown at numeral 40 and the fly and bed knives are shown respectively at numerals 42 and 44. A rotor vertical center plane is defined by vertical center lines Vcl and Vcl′ on each end of the rotor. Similarly a horizontal center plane is defined by horizontal center lines Hcl and Hcl′ on each end of the rotor. The bed knife is elevated above the horizontal center plane of the rotor by a shear angle S. The fly knife is also oriented so that when the rotor is approximately positioned, it will intersect this horizontal center plane of the rotor from the opposite direction by angle S′ which is equal to angle S. The two ends 46 and 48 of the bed knife are laterally displaced from the center plane of the rotor at different positions. In FIG. 3 the perpendicular lateral distance of end 46 from the vertical center plane of the rotor (distance x) is greater than the perpendicular lateral distance of end 48 from the vertical center plane of the rotor (distance y). Thus in the case illustrated camber (C) equals y minus x. Rotor length is shown as L. R is the cutting radius of the distance between the longitudinal axis of the rotor and the terminal edge of the fly knife. The overall relationship between the above described factors in the cutter of the present invention is defined by the formula $$C=R-\sqrt{R^2-(\text{tangent } S\times L)^2}$$

Figure 4A:
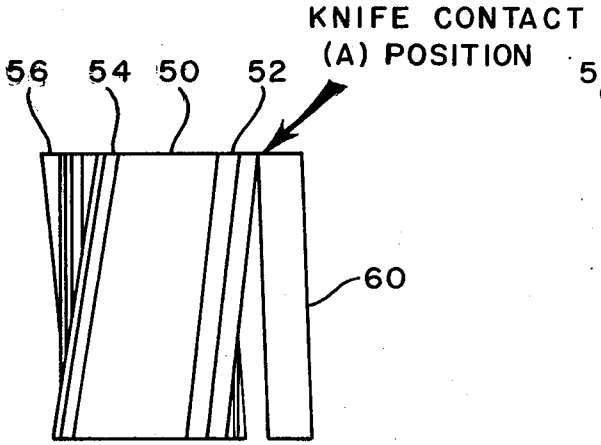
FIGS. 4*a–c* are plan views of the rotor and bed knife elements of the apparatus of the present invention showing the relative positions of these elements as the rotor progressively rotates through three sequential positions.
Figure 4B:
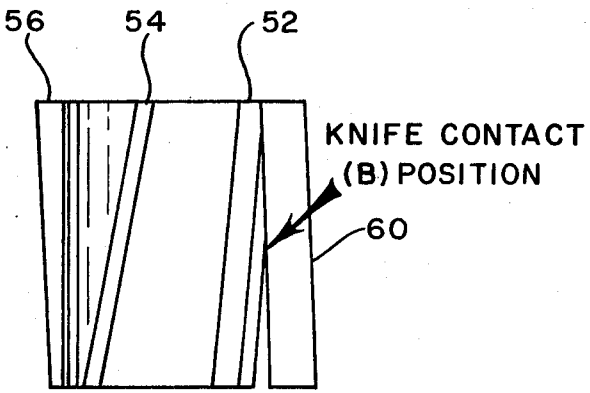
Figure 4C:
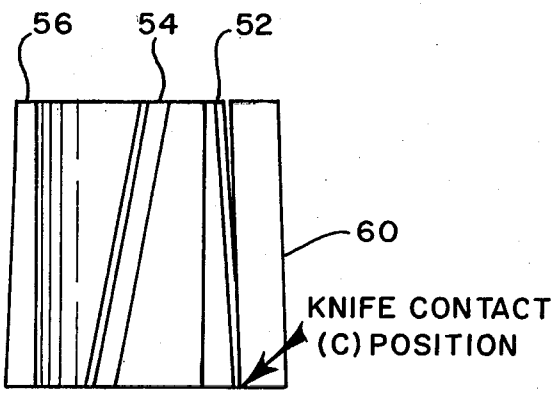
Figure 5A:
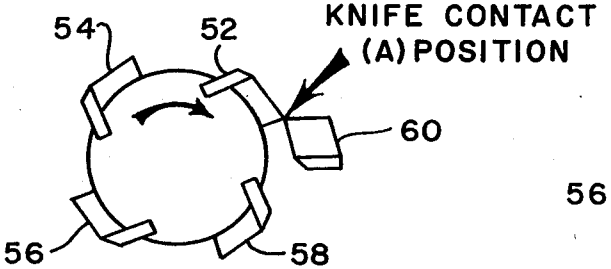
FIGS. 5*a–c* are end views of the rotor and bed knife elements of the apparatus of the present invention corresponding respectively, to FIGS. 4*a–c.
Figure 5B:
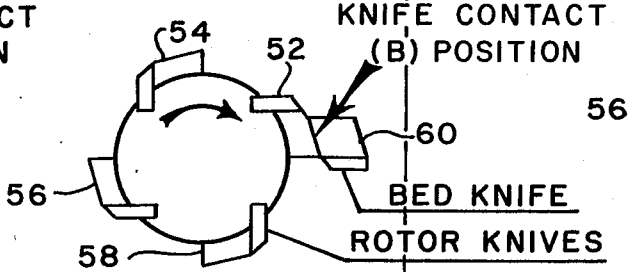
Figure 5C:
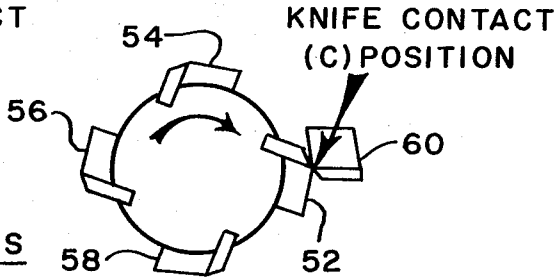
Figure 6:
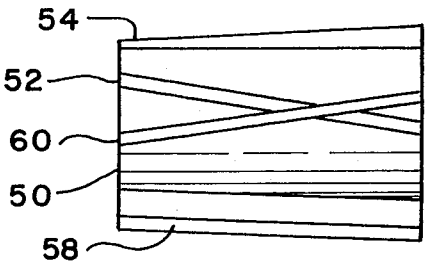
* and FIG. 6 is a side view of the rotor and bed knife elements of the apparatus of the present invention taken from VI—VI on FIG. 5*b*.

Referring to FIGS. 4*a–c*, 5*a–c* and 6, there is shown another rotor 50 which has multiple fly knives 52, 54, 56 and 58 that sequentially engage bed knife 60. FIGS. 4*a* and 5*a* show fly knife 52 initially engaging bed knife 60. FIGS. 4*b* and 5*b* show the relative positions of these knives after the rotor has rotated slightly in a clockwise direction. FIGS. 4*c* and 5*c* show the relative positions of these knives as the rotor has rotated still further in a clockwise direction. As is shown particularly in FIG. 6, at any one time the point of engagement between these two knives is limited to a small area. As the rotor turns, this point of contact moves from one side to the other of the knives. As a result of the above described action, uniform fly knife to bed knife clearance is maintained across the face of the rotor. As the rotor turns still further, fly knives 54, 56 and 58 will be sequentially engaged by the bed knife in the same way that fly knife 52 was engaged.

It will be appreciated that a rotary cutter without curved blades has been described in which the cutting elements are arranged to allow efficient cutting of even of thin materials. Although the invention has been described with a certain degree of particularity, it is to be understood that the present disclosure has been made only as an example and that the scope of the invention is defined by what is hereafter claimed.

What is claimed is:

1. In a rotary cutting apparatus comprising a cutting chamber; a generally cylindrical rotor mounted within said cutting chamber for rotation about its longitudinal axis, said rotor having a vertical center plane and a horizontal center plane and at least one longitudinal fly knife peripherally fixed to said rotor, at least one bed knife having first and second terminal ends and intersecting the horizontal center plane of the rotor at a shear angle and situated adjacent said rotor for cooperative cutting action with said fly knife as said rotor is rotated about its longitudinal axis to effect size reduction of material fed into said chamber, wherein the improvement is comprised in the fly and bed knives being relatively positioned at least at one point in the rotation of the rotor such the bed and fly knives cross and said fly knife intersects said horizontal center plane of the rotor from an opposite direction from said bed knife at an angle equal to said shear angle and said fly and bed knives are further approximately positioned according to the formula $$C=R-\sqrt{R^2-(\text{tangent } S\times L)^2}$$

wherein C is the difference between the peripendicular lateral distances between the first end on the bed knife and the vertical center plane of the rotor and the second end on the bed knife and the vertical center plane of the rotor, R is the distance between the longitudinal axis of the rotor and the terminal edge of the fly knife, S is the shear angle betwen the bed knife and the horizontal center plane of rotor, L is the length of the rotor and C, R and L are in a common linear dimension, such that uniform fly knife to bed knife clearance is maintained across the face of the rotor.

2. The rotary cutting apparatus defined in claim 1 wherein there is one fly knife and one bed knife.

3. The rotary cutting apparatus defined in claim 1 wherein there is one bed knife and a plurality of fly knives and each fly knife is relatively positionable to the bed knife in a manner similar to every other fly knife.

4. The rotary cutting apparatus defined in claim 1 wherein there are multiple fly and bed knives and each fly knife is relativewly positionable to each bed knife in a manner uniform with the respective relative positioning of every other fly and bed knife.

* * * * *